US011463807B2

(12) United States Patent
Horyn et al.

(10) Patent No.: US 11,463,807 B2
(45) Date of Patent: Oct. 4, 2022

(54) SOUND DIFFUSION DEVICE WITH FIXED NON-CONSTANT CURVATURE

(71) Applicant: L-ACOUSTICS, Marcoussis (FR)

(72) Inventors: Yoachim Horyn, Orsay (FR); Christophe Combet, Antony (FR); Christian Heil, London (GB)

(73) Assignee: L-ACOUSTICS, Marcoussis (FR)

( * ) Notice: Subject to any disclaimer, the term of this patent is extended or adjusted under 35 U.S.C. 154(b) by 13 days.

(21) Appl. No.: 17/261,513

(22) PCT Filed: Jul. 19, 2019

(86) PCT No.: PCT/FR2019/051817
§ 371 (c)(1),
(2) Date: Jan. 19, 2021

(87) PCT Pub. No.: WO2020/016538
PCT Pub. Date: Jan. 23, 2020

(65) Prior Publication Data

US 2021/0297772 A1 Sep. 23, 2021

(30) Foreign Application Priority Data

Jul. 19, 2018 (FR) ..... 1856699

(51) Int. Cl.
*H04R 1/34* (2006.01)
*H04R 1/40* (2006.01)
*H04R 27/00* (2006.01)

(52) U.S. Cl.
CPC ..... *H04R 1/345* (2013.01); *H04R 1/403* (2013.01); *H04R 27/00* (2013.01)

(58) Field of Classification Search
CPC ..... H04R 1/345; H04R 1/403; H04R 27/00
(Continued)

(56) References Cited

U.S. PATENT DOCUMENTS 9,911,406 B2 * 3/2018 Butler ..... H04R 1/403
10,356,512 B1 * 7/2019 Peace, Jr. ..... H04R 1/345
(Continued)

FOREIGN PATENT DOCUMENTS

EP 1686830 A1 8/2006
EP 3063950 A1 9/2016
WO 2020016538 A1 1/2020

OTHER PUBLICATIONS

Foreign Communication from a Related Counterpart Application, International Search Report dated Nov. 14, 2019, International Application No. PCT/FR2019/051817 filed on Jul. 7, 2019.
(Continued)

*Primary Examiner* — Sean H Nguyen

(57) ABSTRACT

The present invention relates to a sound diffusion device (300) comprising a single box (310) and, in this single box (310), at least two superimposed high-frequency acoustic sources (320), and a plurality of superimposed medium and/or low-frequency sources (330) and arranged to the left and/or to the right of the high-frequency acoustic sources (320), the high-frequency acoustic sources (320) being coupled individually to a wave guide (340) so as to generate a vertical wave front with a fixed non-constant curvature. Such a device (300) makes it possible to minimise discontinuities between the acoustic sources providing high quality sound diffusion (no parasite lobe), to considerably reduce the weight and the cost of manufacturing and also enables rapid installation which does not require the angular adjustment of each acoustic source relative to one another contrary to existing devices.

13 Claims, 15 Drawing Sheets

(58) Field of Classification Search
USPC ..... 381/94.1
See application file for complete search history.

(56) References Cited

U.S. PATENT DOCUMENTS

| | | | | |
|---|---|---|---|---|
| 2002/0114482 | A1 | 8/2002 | Adamson | |
| 2017/0353786 | A1* | 12/2017 | Button | H04R 1/025 |
| 2019/0215602 | A1* | 7/2019 | Halley | H04R 1/025 |

OTHER PUBLICATIONS

Foreign Communication from a Related Counterpart Application, Written Opinion dated Nov. 14, 2019, International Application No. PCT/FR2019/051817 filed on Jul. 7, 2019.

* cited by examiner

SOUND DIFFUSION DEVICE WITH FIXED NON-CONSTANT CURVATURE

CROSS-REFERENCE TO RELATED APPLICATIONS

The present application is a filing under 35 U.S.C. 371 as the National Stage of International Application No. PCT/FR2019/051817, filed Jul. 19, 2019, entitled "SOUND DIFFUSION DEVICE WITH FIXED NON-CONSTANT CURVATURE," which claims priority to French Application No. 1856699 filed with the Intellectual Property Office of France on Jul. 19, 2018 both of which are incorporated herein by reference in their entirety for all purposes.

TECHNICAL FIELD

The present invention relates to a sound diffusion device for a performance space such as the stage of a concert hall or an open-air festival.

PRIOR ART

The purpose of a modern sound system is to ensure sound coverage for the audience which is as homogenous as possible and covers the whole audio spectrum (20 Hz-20 kHz).

It relates to delivering to spectators a sound volume (dB SPL—decibel Sound Pressure Level), preferably of equivalent intensity, which can be adjusted as desired by the installer. It is also necessary to guarantee optimum sound quality, i.e. free of interference.

To achieve this it is common to multiply the acoustic sources within a sound diffusion device or system. The contributions from each of the acoustic sources would add up correctly if all of the acoustic sources were arranged at the same point. In practice this is impossible as an acoustic source has a non-negligible volume.

In addition, the use of "source point type" speakers makes it impossible to achieve the objective of homogenous sound intensity as the natural attenuation of this type of product is 6 dB per doubling of the distance.

In order achieve a higher SPL, it is also possible to assemble a plurality of speakers of this type. This arrangement generates for the audience an interferential sound field for frequencies where the half wavelength is shorter than the distance separating the elements.

The use of speakers, referred to as "source lines" makes it possible to achieve the aforementioned objectives by considerably improving the ability to transmit the sound intensity a long distance while still ensuring a loss of 3 dB solely by doubling the distance at high frequencies, and ensuring a sound field that is free of any interference.

The speakers of the "source line" type consist of:

- stacking the low and medium loudspeakers on top of one another to form a curved line, leaving a step between the loudspeakers which is less than the smallest half wavelength that each loudspeaker needs to reproduce;
- using the tweeter loudspeakers (compression motors) coupled to waveguides with rectangular output, the assembly generating an isophase linear wave front free of interference even when the step between two motors is much greater than the smallest wavelength to be reproduced.

A wave guide is a physical device which makes it possible to obtain at the output a possibly flat isophase wave front. For this reason, it performs the same role as a funnel that would be provided on a compression motor, the main difference being that it takes up less space. Indeed, obtaining a flat isophase wave front at the output would require a funnel of infinite length, contrary to the desired compactness of a sound diffusion device.

In addition, in order to be able to adapt to all types of audiences and to be able to model as desired the attenuation of the SPL on the audience, these speakers are generally designed in a modular manner as relatively small elements, the height of which is overall that of the highest loudspeaker.

Each speaker can then be inclined relative to its neighbour in a variable manner in order to achieve the objectives of coverage, intensity and homogeneity.

This angular flexibility makes it possible to focus the energy in one direction (generally the remote audience) by stacking lots of speakers with a small angle or no angle between the elements or, otherwise to cover a large angular sector using little energy by assembling the speakers with large angles between the elements.

This flexibility linked to the modularity of small orientable elements has a number of disadvantages however:

- the multiplication of fixing devices with a variable angle between the speakers which involves longer installation time, extra cost and extra weight;
- numerous wooden panels for shutting down the acoustic volume of each element, which also generates extra cost and extra weight;
- a discontinuity of the wave front due to the presence of these separating panels and the play required for assembly, leading to the appearance of offset parasite lobes. These uncontrolled lobes may for example be the cause of undesired feedback (i.e. Larsen) for the musician on stage; and
- a loss of acoustic volume due to the generally trapezoidal cross-section of a speaker (so as to be able to incline the latter relative to an adjacent element without amplifying the discontinuity of the wave front).

Thus, there is a real need for a simple sound diffusion device which can be installed rapidly, which can be adjusted to any type of audience and provides high quality sound diffusion (no parasite lobe).

DESCRIPTION OF THE INVENTION

In order to address one or more of the aforementioned disadvantages, the invention relates to a sound diffusion device comprising a single box and, in this single box, at least two superimposed high-frequency acoustic sources, and a plurality of superimposed medium-frequency and/or low-frequency acoustic sources, arranged to the left and/or right of the high-frequency acoustic sources, the high-frequency acoustic sources being coupled individually to a wave guide so as to generate a vertical wave front with a fixed non-constant curvature.

More particularly, the at least two superimposed high-frequency acoustic sources form a curved vertical stack. Advantageously, this curved vertical stack has a fixed non-constant physical curvature. Each high-frequency acoustic source has a main direction of emission. The physical curvature of a curved vertical stack is clearly the same as the curvature of the arc representing the profile curve of this curved vertical stack.

Another definition of the physical curvature of the curved vertical stack of the high-frequency acoustic sources can also be the succession of angles formed by the main directions of emission of two consecutive acoustic sources.

For a number of high-frequency acoustic sources N greater than or equal to three, a physical curvature of the curved vertical stack of non-constant high-frequency acoustic sources is a curvature for which at least one angle alpha_i, formed by the main directions of emission of two consecutive high-frequency acoustic sources, i being an integer between 1 and N−1, is different from other angles alpha_n, for n different from i.

A physical curvature of the curved vertical stack of fixed high-frequency acoustic sources is, more precisely, a curvature which cannot be modified by a user.

Features or particular embodiments, which can be used alone or in combination, include:

- each wave guide comprises an output, the outputs of the wave guides being arranged in a perfectly joined manner, so as to form a continuous band;
- the curvature of the vertical wave front is non-constant and fixed and its evolution is monotonic;
- the high-frequency sources are individually controlled electronically in amplitude and in phase so as to adjust the resulting wave front to diffusion objectives for an audience;
- among the plurality of medium and/or low-frequency acoustic sources there is at least one acoustic source emitting in a medium-frequency range, the sound diffusion device also comprising:
  - orientable flaps affecting a sound emission of at least one of the high-frequency acoustic sources to produce a directivity of sound emission of the high-frequency acoustic source according to a selected angular sector, the high-frequency acoustic source and the acoustic source emitting in a medium-frequency range being configured to emit over a common frequency range; and
  - at least one digital signal processor type of control module acting on a destination signal of the high-frequency acoustic source and on a destination signal of the acoustic source emitting in a medium-frequency range so as to apply in the common range of frequencies at least on parameter of magnitude on the high-frequency acoustic source and/or on the acoustic source emitting in a medium-frequency range as well as at least one phase parameter on the high-frequency acoustic source and/or on the acoustic source emitting in a medium-frequency range so as to produce a sound emission directivity of the couple formed by the high-frequency acoustic source and the acoustic source emitting in a medium-frequency range according to the same angular range selected as the directivity produced by the orientable flaps.

Another feature which can be used alone or in combination with the preceding ones is that the curvature of the curved vertical stack has a monotonic progression.

Another feature that can be used alone or in combination with the preceding features is that the sound diffusion device comprises at least three high-frequency acoustic sources.

Another feature which can be used alone or in combination with the preceding features is that the electronic control and amplification channels are capable of supplying each or a plurality of high-frequency sources, as well as each or a plurality of acoustic sources among the plurality of medium-frequency and/or low-frequency acoustic sources.

For coverage of an audience remote from the stage, the invention relates in particular to a sound diffusion device with an extended range, wherein the assembly of high-frequency acoustic sources produces a global directivity of sound emission with a total vertical opening angle less than or equal to 20°.

To cover an audience close to the stage, the invention also relates to a sound diffusion device with an extended vertical opening, wherein the assembly of high-frequency acoustic sources produces a global directivity of sound emission having a total vertical opening angle of above 20°.

To cover an audience of larger size, the invention also relates to a sound diffusion assembly which can comprise at least one first sound diffusion device with an extended range and a sound diffusion device as defined above, superimposed such that the resulting sound diffusion assembly generates a vertical wave front with a fixed non-constant curvature.

In other words, advantageously, the sound diffusion device with extended range can be coupled and is assembled with another sound diffusion device as defined above.

In particular, the sound diffusion device with extended range can be coupled to an identical sound diffusion device with extended range. The term "identical" should be understood to mean a device which is a strict copy of the sound diffusion device "with extended range" 300_F, with exactly the same technical, geometric and physical features. In other words, the sound diffusion device with extended range can be homo-coupled.

The diffusion assembly comprising at least one first sound diffusion device with extended range and a sound diffusion device as defined above, superimposed, forms a curved vertical stack having a fixed non-constant physical curvature.

Particular features or embodiments which can be used alone or in combination with this assembly, include:

- high-frequency sources are individually controlled electronically in amplitude and in phase so as to adjust the resulting wave front to the diffusion objectives for an audience and compensate for a possible non-monotonicity generated by an assembly of such devices; and/or
- the sound diffusion assembly also comprises fixing means configured such that each sound diffusion device is connected to the sound diffusion device located above, respectively below, by fixing points without angular adjustment.

Another feature of this assembly, which can be used alone or in combination with the preceding features, is that the high-frequency sources of the different sound diffusion devices of the sound diffusion assembly are controlled individually electronically in amplitude and in phase so as to adjust a resulting wave front to diffusion objectives for an audience and compensate for a possible non-monotonicity of the physical curvature of the curved vertical stack formed by the diffusion assembly, generated by assembling the devices with one another.

Another feature, which can be used alone or in combination with the preceding features, is that the individual electronic control in amplitude and in phase of high-frequency sources, combined with electronic control in amplitude and in phase of the plurality of medium-frequency and/or low-frequency acoustic sources can be dependent on the considered frequency.

Another feature, which can be used alone or in combination with the preceding features, is that each of a plurality of electronic control and amplification channels can supply one or more of the one or more high-frequency sources of different sound diffusion devices of the sound diffusion assembly as well as one or more of the plurality of medium-frequency and/or low-frequency acoustic sources of different sound diffusion devices of the sound diffusion assembly.

BRIEF DESCRIPTION OF THE FIGURES

The invention will be better understood by reading the following description, given purely by way of example, and with reference to the accompanying Figures in which:

FIG. 7*a* shows the physical deployment of this stack in the vertical plane and the positioning of two characteristic points of the audience: the mixing booth (FOH) and the start of the audience (Proximity);

FIG. 7*b* shows the frequency response curves in magnitude of this deployment on the audience, on the stage and on the ceiling, without application of the electronic control;

FIG. 7*c* shows the frequency response curves in phase of this deployment at two characteristic points of FIG. 7*a*, without application of the electronic control, and after subtraction of the minimum propagation period;

FIG. 7*d* shows the frequency response curves in magnitude of this deployment on the audience, on the stage and on the ceiling, after application of the electronic control for the purpose of homogenisation; and FIG. 7*e* shows the frequency response curves in phase of this deployment at two characteristic points of FIG. 7*a*, after application of the electronic control ends for the purpose of homogenisation, and after subtraction of the minimum propagation period;

FIG. 8*a* shows the physical deployment of this stack in the vertical plane and the positioning of two characteristic points of the audience: the mixing booth (FOH) and start of the audience (Proximity);

FIG. 8*b* shows the frequency response curves in magnitude of this deployment on the audience, on the stage and on the ceiling, without application of the electronic control;

FIG. 8*c* shows frequency response curves in phase of this deployment at two characteristic points of FIG. 8*a*, without application of the electronic control, and after subtraction of the minimum propagation period;

FIG. 8*d* shows the frequency response curves in magnitude of this deployment on the audience, on the stage and on the ceiling, after application of the electronic control for the purpose of homogenisation; and FIG. 8*e* shows the frequency response curves in phase of this deployment at two characteristic points of FIG. 8*a*, after application of the electronic control for the purpose of homogenisation, and after subtraction of the minimum propagation period;

FIG. 9*a* shows the physical deployment of this device in the vertical plane and the positioning of two characteristic points of the audience: the mixing booth (FOH) and the start of the audience (Proximity);

FIG. 9*b* shows the frequency response curves in magnitude of this device on the audience, on the stage and on the ceiling, without application of the electronic control;

FIG. 9*c* shows frequency response curves in phase of this device at two characteristic points of FIG. 9*a*, without application of the electronic control, and after subtraction of the minimum propagation period;

FIG. 9*d* shows the frequency response curves in magnitude of this device on the audience, on the stage and on the ceiling, after application of the electronic control for the purpose of homogenisation; and FIG. 9*e* shows frequency response curves in phase of this device at two characteristic points of FIG. 9*a*, after application of the electronic control for the purpose of homogenisation, and after subtraction of the minimum propagation period;

DEFINITIONS

In the remainder of the description, "a sound diffusion device" is formed by one or more acoustic sources for which the frequency ranges or bands can be identical or different.

A cut, which is arbitrary, but frequently used in the field, cuts the sound spectrum, covering at least partially the human audible range of 20 Hz-20 kHz, into three or four frequency bands. A high-frequency band, HF, covers the highest frequencies corresponding to high-frequency sounds, is typically a range of 1 kHz-20 kHz. A medium-frequency band, MF, covers intermediate frequencies, is typically a range of 200 Hz-1 kHz. A low-frequency band, LF, covers the low frequencies corresponding to bass sounds, is typically a range of 60 Hz-200 Hz. Lastly, a very low-frequency band corresponding to low bass or subwoofer sounds, TBF, optionally covers the lowest frequencies, typically frequencies lower than 60 Hz. In practice, the same component can be used to restore the signals of LF and MF bands. Generally, an acoustic source can emit over a plurality of frequency ranges but will be defined in the following by its main emission range.

Figure 1A:
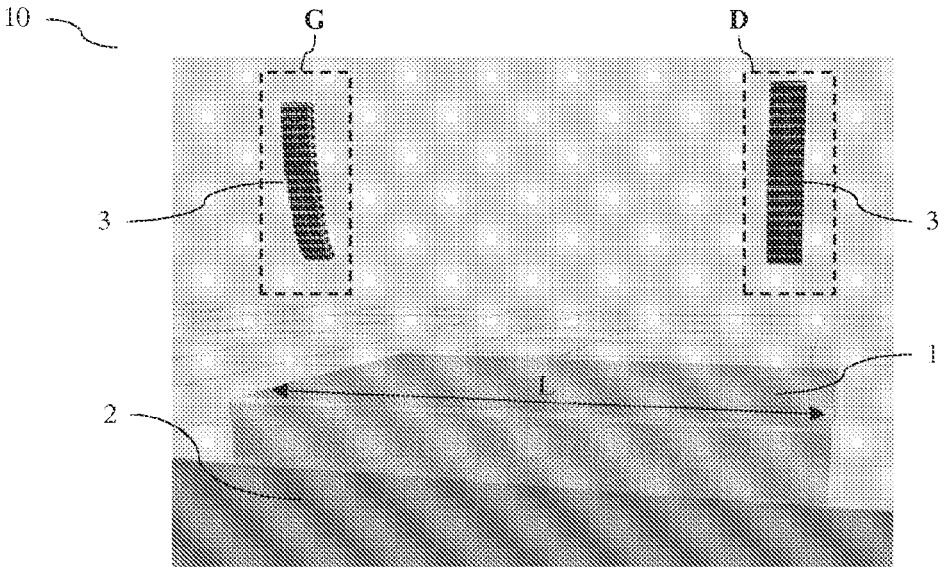
FIGS. 1*a* and 1*b* show a stage equipped with sound diffusion devices arranged in a standard stereo arrangement (FIG. 1*a*) or an arrangement adjusted to diffuse a spatialised sound signal (FIG. 1*b*)
Figure 1B:
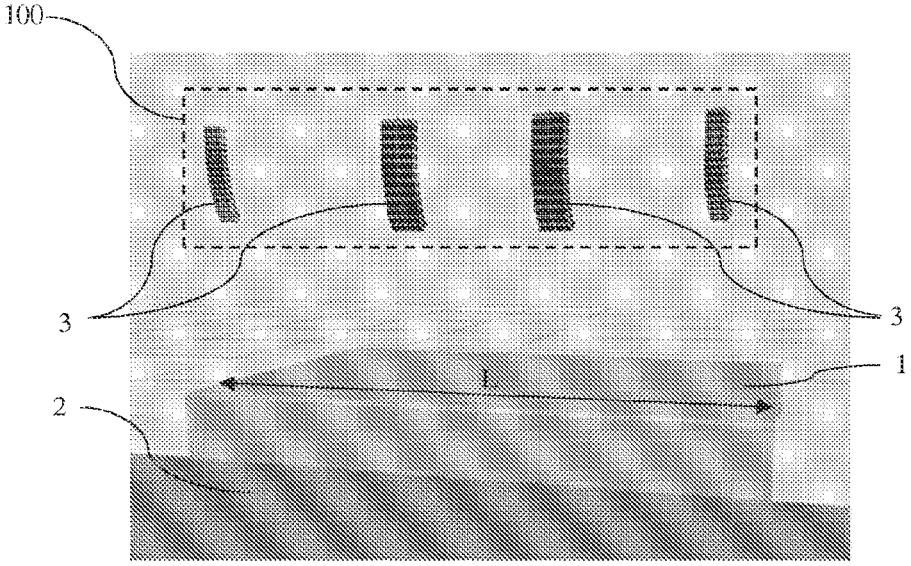
Figure 2:
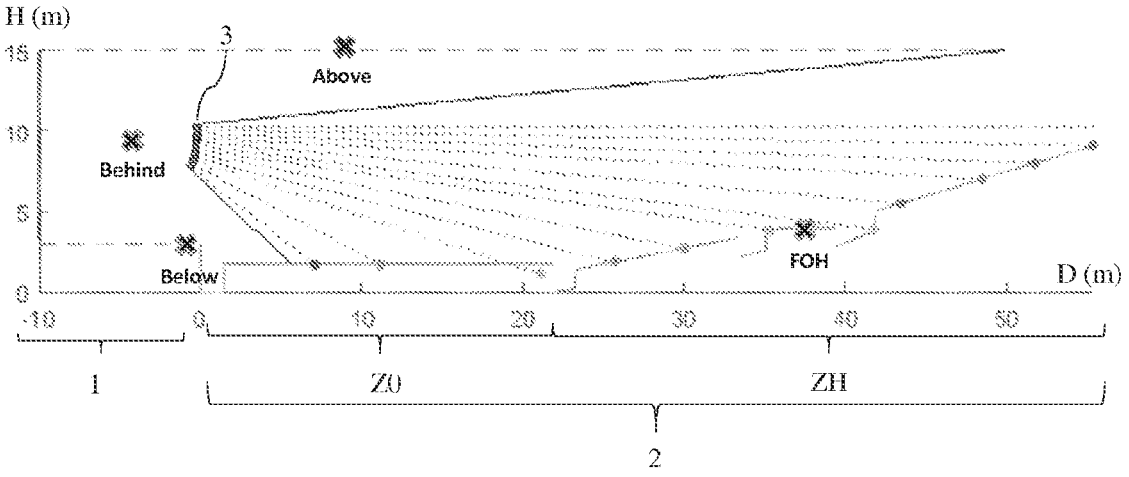
FIG. 2 shows a stage, the physical distribution of an audience viewed in profile, as well as the positioning of four characteristic points of the audience: the mixing booth (FOH), Below, Behind and Above the sound diffusion device.

In the remainder of the description the term "audience" denotes the physical distribution of listeners or spectators attending a show relative to a stage. As shown in FIGS. 1*a*-1*b* and 2, this physical distribution can have different configurations.

For example, in a concert hall the audience 2 may be relatively close to the stage 1, whereas at an open-air festival the audience 2 may be more widespread.

The audience 2 can also be distributed in height, where the spectators are either on ground level ZO or are raised in tiers or by any similar structure ZH.

Depending on the audience, the objectives of sound diffusion are fixed by sound engineers. These objectives relate to the distribution of sound and the sound quality for the audience. To achieve this the sound engineers rely on frequency response curves such as those shown in 7*b* to 7*e*, or even 8*b* to 8*e*. In these graphs, each curve represents the sound level in dB or the phase in degrees as a function of the frequency that a listener, placed at a point in the audience, hears.

Ideally, when the diffused sound is homogenous for the whole audience (i.e. the same sound level and the same frequency contour), all of the curves in magnitude should be superimposed. However, in reality, rather there tends to be an attenuation in level between the front (close to the stage) and the back (remote from the stage) of the audience.

One of the objectives is therefore that all of the curves have the same form (i.e. the same frequency contour) and are as close as possible to one another. Other kinds of objectives exist, such as for example:

- having an attenuation of the linear sound level between the front and the back of the audience, which would be represented by regularly spaced curves; or also
- having a constant level in a first part of the audience then linearly decreasing in a second part, which would be represented by a first set of close curves and a second set with regularly spaced curves.

Also, one of the objectives is that all of the frequency components of the sound signal emitted by the sound diffusion device arrive at the same instant and in phase at any point of the audience.

Ideally, according to this objective, the frequency response curves in phase should be all mixed with the phase zero horizontal axis after subtraction of the minimum propagation period.

The minimum propagation period is defined as the time taken by the acoustic pressure wave to reach a given point in the audience, from the closest speaker.

Once the objectives of the desired sound diffusion have been defined, it is necessary to select the sound diffusion device or devices to be used.

Each sound diffusion device can be defined by three main technical features: its total vertical opening, its total horizontal opening and its range.

The term "range" denotes the distance between the sound diffusion device 3, generally located at the front of the stage 1, and the depth at which the sound diffused by this device 3 is heard correctly (in an intelligible/coherent manner) in the audience 2.

The term "total opening", or directivity lobe, usually denotes double the angle at which a loss of 6 dB is observed, corresponding to a reduction of 50% of the sound intensity, relative to the axis of the sound device concerned, namely vertically or horizontally. This axis is defined as the direction in which sound intensity is at a maximum in the considered direction.

EMBODIMENTS

FIG. 1*a* illustrates a standard stereo arrangement 10 comprising two sound diffusion devices 3, both located at a height above the stage 1, one situated to the left L and the other to the right R of the stage 1. FIG. 1*b* illustrates an arrangement 100 suitable for diffusing a spatialised sound signal and comprising four sound diffusion devices 3.

Each sound diffusion device 3 comprises a vertical stack of speakers which are inclined relative to one another so as to incline mechanically the overall vertical directivity of the sound diffusion device 3 in the direction of the audience 2.

To illustrate this phenomenon, the profile view of the stage 1 and of such a sound diffusion device 3, FIG. 2, makes it possible to see in dotted lines the axis normal to each speaker and its inclination as a function of the targeted area of the audience 2. Thus, the installation of such a device 3 is highly complex as it is necessary to determine the optimum angle of inclination between each speaker for targeting according to the audience 2 the key or median points which enable a homogenous distribution of sound diffused to the audience 2. In addition, such a stack of speakers creates a non-continuous wave front.

Figure 3A:
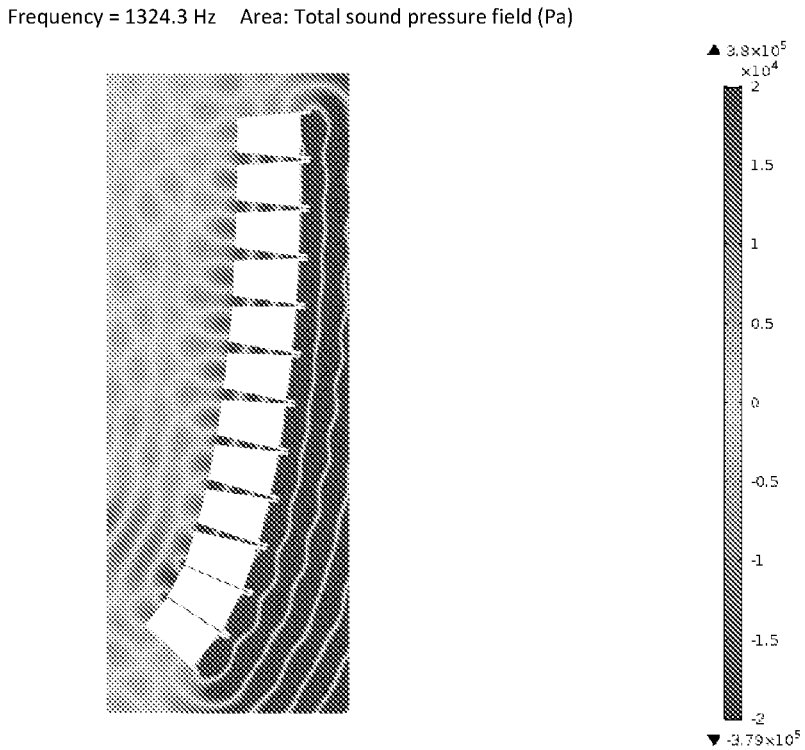
FIGS. 3*a* and 3*b* show respectively the acoustic pressure field around a sound diffusion device composed of a curved vertical stack of speakers generating a non-continuous wave front and the sound level generated by such a sound diffusion device at four characteristic points of FIG. 2, referenced relative to the sound level in the mixing booth.
Figure 3B:
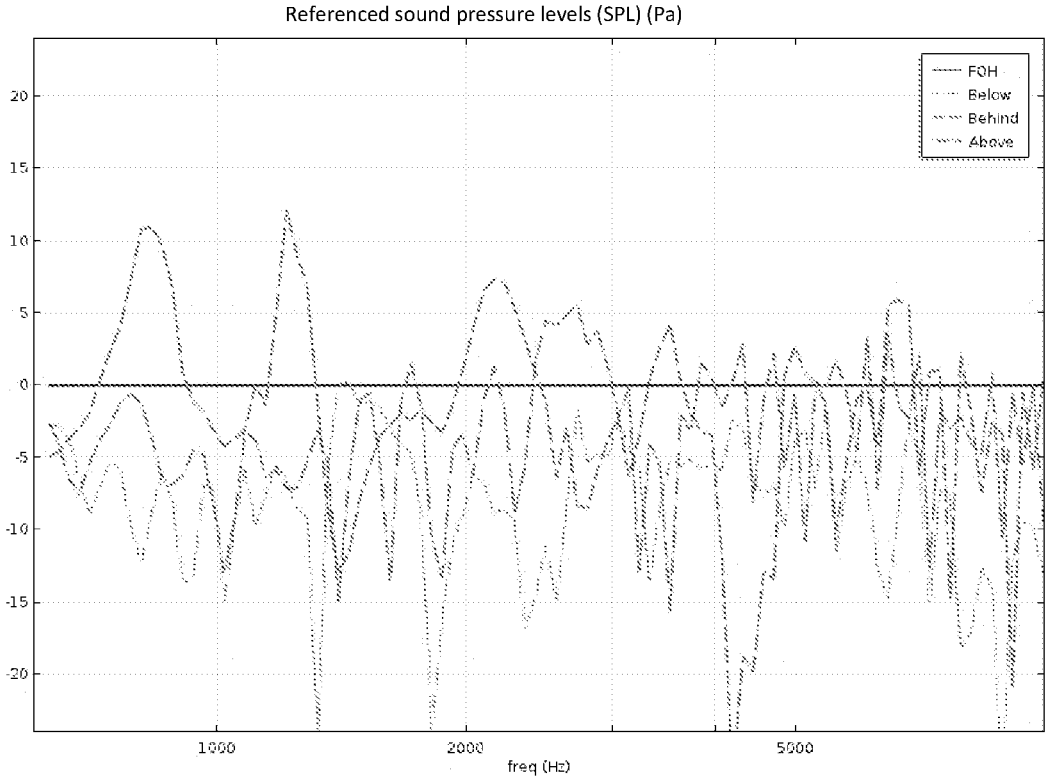

FIG. 3*a* shows the acoustic pressure field around such a device 3 at the particular frequency of 1324 Hz, corresponding to the appearance of a peak of sound intensity at the back of the device 3. A dark grey area shows significant acoustic pressure, and therefore a significant sound level. In contrast, a light grey area shows a reduced sound level. FIG. 3*b* shows the sound level generated at four characteristic points of the audience: the mixing booth (FOH), Below, Behind and Above such a sound diffusion device 3, relative to the sound level in the mixing booth. The device 3 is composed here of an assembly of 12 speakers of variable curvature, each speaker being composed of a HF source and two MF sources, with 13 mm thick separating panels and assembly play between each speaker in the order of 5 mm. These graphs make it possible to see the presence of significant and non-desirable sound levels below, behind and above and above the sound diffusion device 3, in comparison to the sound level in the mixing booth.

Figure 4:
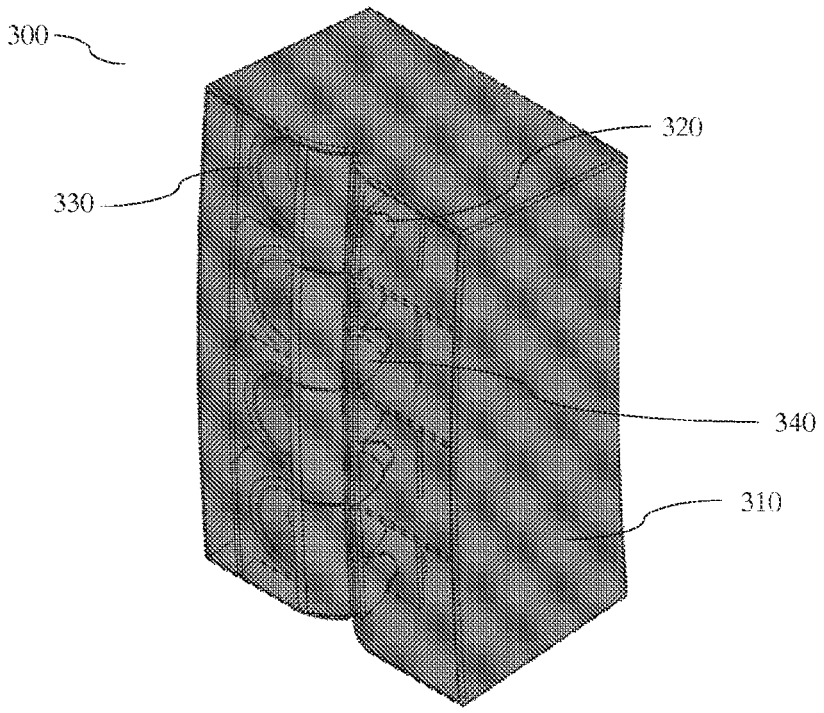
FIG. 4 shows a sound diffusion device according to a first embodiment of the invention.

To address these installation problems as well as the presence of parasites lobes on the stage 1, a first embodiment of the invention relates to a sound diffusion device 300 as illustrated in FIG. 4.

The sound diffusion device 300 comprises a single box 310, and in this single box, at least two superimposed high-frequency acoustic sources 320, and a plurality of superimposed medium-frequency and/or low-frequency acoustic sources 330 arranged to the left and/or to the right of the high-frequency acoustic sources 320, the high-frequency acoustic sources 320 being coupled individually to a wave guide 340 so as to generate a vertical wave front with a fixed non-constant curvature.

The at least two superimposed high-frequency acoustic sources form a curved vertical stack. Advantageously, this curved vertical stack has a fixed non-constant physical curvature. Each high-frequency acoustic source has a main direction of emission. The physical curvature of a curved vertical stack is clearly the same as the curvature of the arc representing the profile curve of this curved vertical stack.

Another definition of the physical curvature of the curved vertical stack of high-frequency acoustic sources can also be the succession of angles formed by the main directions of emission of two consecutive acoustic sources.

Advantageously, the sound diffusion device 300 comprises at least three high-frequency acoustic sources 320.

For a number of high-frequency acoustic sources N greater than or equal to three, a physical curvature of the curved vertical stack of non-constant high-frequency acoustic sources is a curvature for which at least one angle alpha_i, formed by the main directions of emission of the i-st and i+1st consecutive high-frequency acoustic sources 320, i being an integer between 1 and N−1, is different from other angles alpha_n, for n different from i.

A physical curvature of the curved vertical stack of fixed high-frequency acoustic sources 320 is a curvature which is not suitable for modification by a user.

Advantageously, each wave guide 340 comprises an output, the outputs of the wave guides being joined together so as to form a continuous band and therefore a continuous wave front.

To obtain a satisfactory sound distribution to the audience without recourse to electronic control, it is preferable that the fixed non-constant curvature of the vertical wave front is monotonic.

Figure 5A:
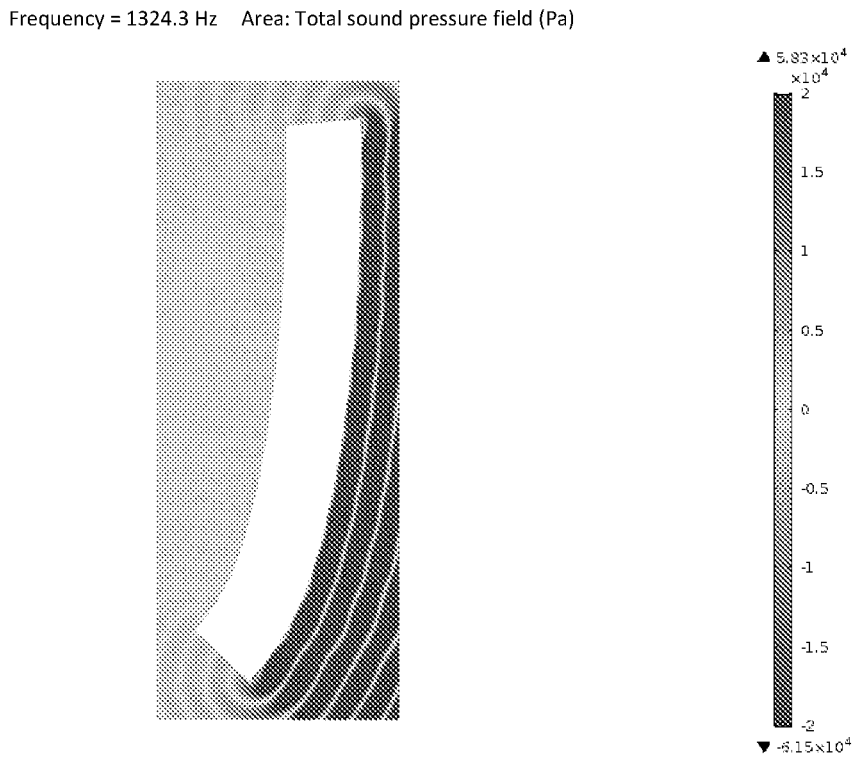
FIGS. 5*a* and 5*b* show respectively the acoustic pressure field around a sound diffusion device according to the embodiment of FIG. 4 and the sound level generated by such a sound diffusion device at four characteristic points of FIG. 2, referenced relative to the sound level of the mixing booth.
Figure 5B:
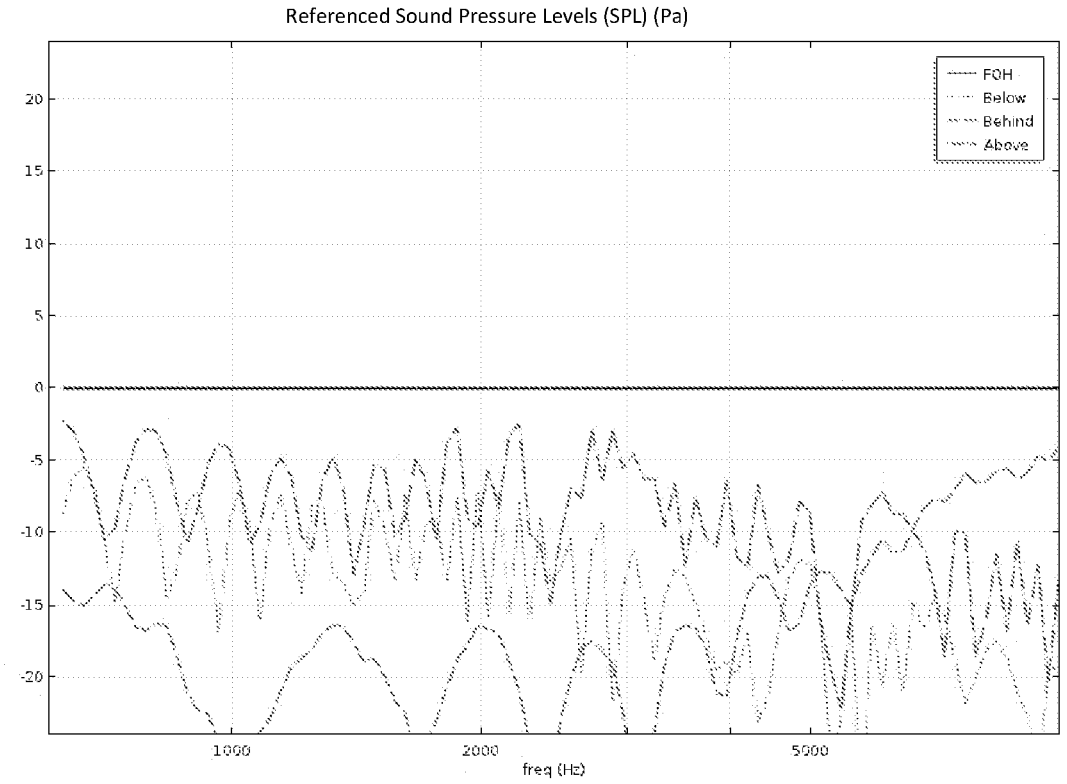

FIG. 5*a* shows the acoustic pressure field around such a device 300 at this same particular frequency of 1324 Hz and with the same colour codes as FIG. 3*a*. FIG. 5*b* shows the sound level generated at three same characteristic points of the audience, referenced relative to the sound level in the mixing booth. The device 300 is composed for this digital simulation of a stack of 12 high-frequency sources, without any separation panels or assembly play, and therefore generating a continuous wave front. These graphs make it possible to see the disappearance or very strong attenuation of parasite lobes of undesirable sound levels below, behind and above the sound diffusion device 300.

Thus, this type of sound diffusion device 300 makes it possible, particularly by combining a plurality of sources in one single speaker (i.e. a single box 310):

- to minimise discontinuities between the acoustic sources reducing or suppressing the parasite lobes;
- to considerably reduce the weight and the manufacturing cost of the device by means of the suppression of different horizontal panels which were present between the acoustic sources in the stack of speakers, also facilitating the transport of the device 300 and its installation; and
- to enable a rapid installation which does not require the angular adjustment of each of the acoustic sources relative to one another.

Indeed, the curvature of the curved vertical stack of high-frequency acoustic sources is fixed and cannot be adjusted by a user. Thus, it is not necessary for the user to make any adjustments for the installation of different sources.

So as to adjust the resulting wave front to diffusion objectives, the high-frequency sources 320 can be individually controlled electronically in amplitude and phase.

The electronic control (or DSP—Digital System Processing) makes it possible to adjust the inclination of the directivity lobe of the assembly without having to incline them physically.

To understand this phenomenon, consider a vertical straight arrangement of N point sources spaced apart by a distance d and having the directivity of a rectangular source of height d, it is possible to show that, at any point of the plan of the arrangement, defined by a distance r and an angle θ to the source, the sound level SPL relative to the axis of projection is:

$$SPL(r,\theta) = 20\log_{10}\left(\left|\frac{\sin\left(\frac{kd\sin\theta}{2}\right)}{\frac{kd\sin\theta}{2}}\,\frac{\sin\left(N\frac{kd}{2}\sin\theta\right)}{N\sin\left(\frac{kd}{2}\sin\theta\right)}\right|\right) \tag{E1}$$

where k is the wave number corresponding to $$\frac{2\pi f}{c}$$

where f is the frequency considered and c is the speed of sound in the medium concerned (here air).

By applying different phase adjustments to each of the sources of the arrangement, it is possible to incline the main sound lobe by an angle $\theta_0$.

In a similar manner it can be shown that the relative sound level is:

$$SPL(r,\theta,\theta_0) = 20\log_{10}\left(\left|\frac{\sin\left(\frac{kd\sin\theta}{2}\right)}{\frac{kd\sin\theta}{2}}\,\frac{\sin\left(N\frac{kd}{2}\sin\theta-\sin\theta_0\right)}{N\sin\left(\frac{kd}{2}\sin\theta-\sin\theta_0\right)}\right|\right) \tag{E2}$$

A physical or electronic adjustment which does not generate a parasite lobe can be considered acceptable for which the sound intensity is greater than −12 dB relative to the main lobe, and this at the same distance from the source.

Thus, it can be shown that there is a maximum angle $\theta_0$ beyond which parasite lobes of greater intensity appear at the threshold defined above. This maximum angle can be expressed as a function of the frequency and the level of the source by the following formula:

$$\theta_{\theta,max} \approx \arcsin\left(\frac{2(\pi - x_0)}{kd}\right) \tag{E3}$$

where xo is the solution of the equation $$\frac{\sin(x)}{x} = 10^{\frac{-12}{20}};\ x_0 \approx 2.47 \tag{E4}$$

In order to reach a near audience, it is usual to have to orient the last speaker of an arrangement by an angle of more than 45° to the horizontal. This is especially true when the arrangement is suspended at great heights, which may be case when it is placed above the stage or the geometry of the site does not allow for low installation.

Figure 6:
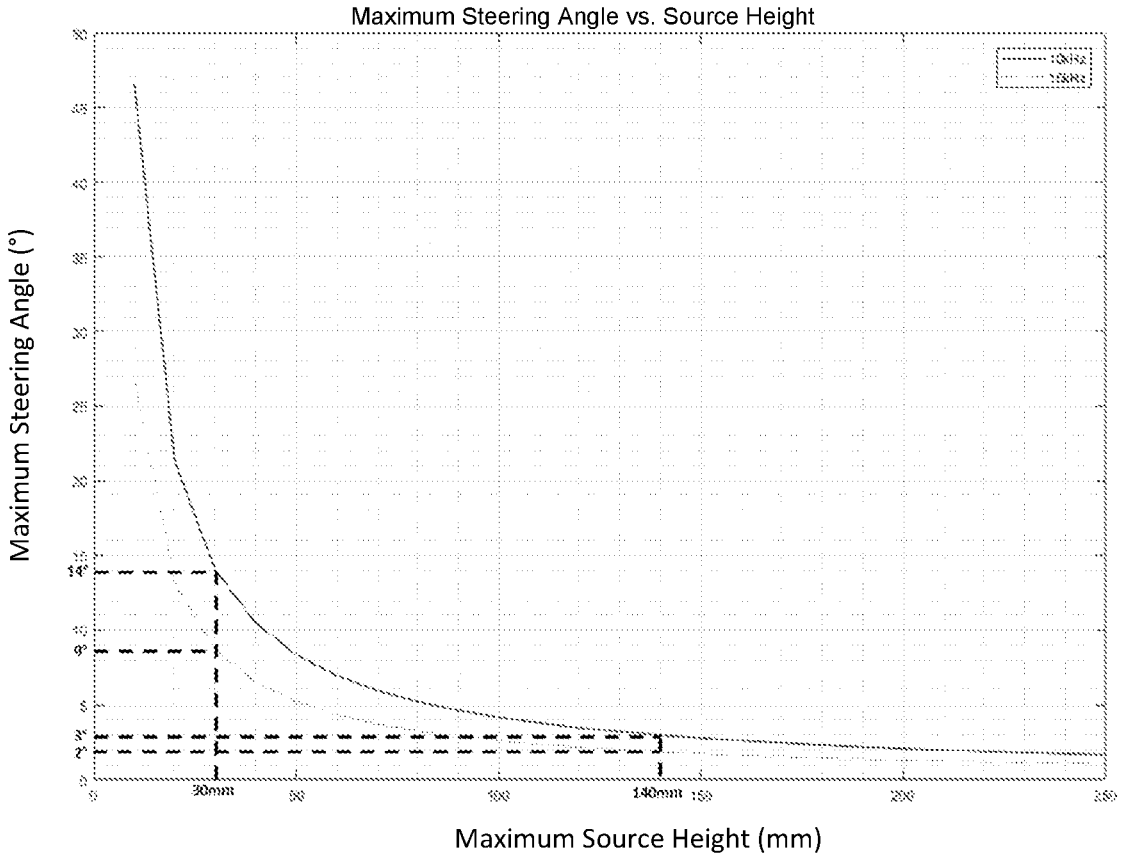
FIG. 6 shows the progression of a maximum angle $\theta_0$ beyond which parasite lobes appear as a function of the level of an acoustic source, for which the inclination of the sound emission directivity is controlled electronically.

The graph of FIG. 6 describes the progression of the maximum angle $\theta_0$ for two frequencies, 10 kHz and 16 kHz, as a function of the height of each source.

It is noted that in order to achieve an angle $\theta_0$ of 45° at 10 kHz, it is necessary to have a unitary source 10 mm in height, and that this source can only be inclined electronically 27° at 16 kHz. Such a discretisation of the source line involves a very high number of small components and amplification channels with DSP, a solution which does not seem to be advantageous.

In the same graph it is shown that for a source 30 mm high, the maximum angle $\theta_0$ is 14° at 10 kHz, and 9° at 16 kHz.

Such a source could be used without too much complexity, but is would not make it possible to achieve the said angle of 45°, even at 10 kHz, without creating parasites lobes outside the scope.

For these reasons, the technique consisting of electronically curving a vertical straight source line does not make it possible to obtain as good results as a physically curved source line.

In contrast, a line with sources 140 mm high, makes is possible to achieve a maximum angle $\theta_0$ of 3° at 10 kHz and of 2° at 16 kHz. Thus the association of a physical curvature adjusted for stacking high-frequency acoustic sources with the individualised electronic control of the latter, combined or not with a low-frequency and/or medium-frequency in amplitude and phase individualised electronic control, would appear to be an optimal solution.

In a more visual and quantitative manner, the following digital simulations illustrate the advantages and disadvantages of these different configurations.

Figure 7A:
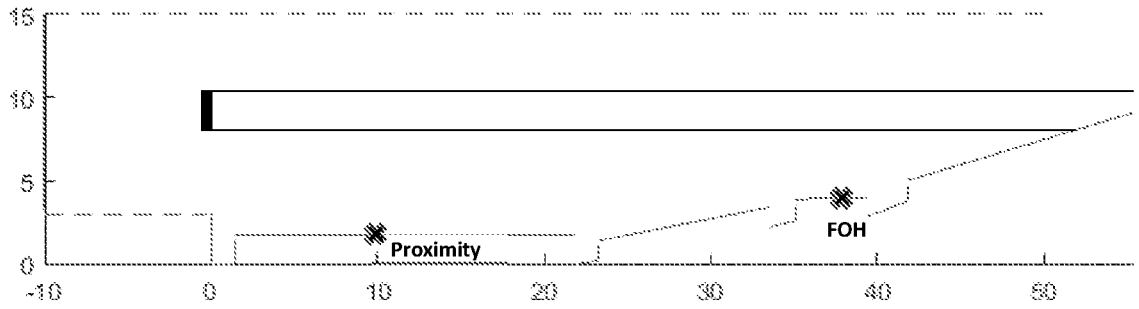
FIGS. 7*a* to 7*e* represent the results of a digital simulation performed for a vertical straight stacking of speakers; in particular.
Figure 7B:
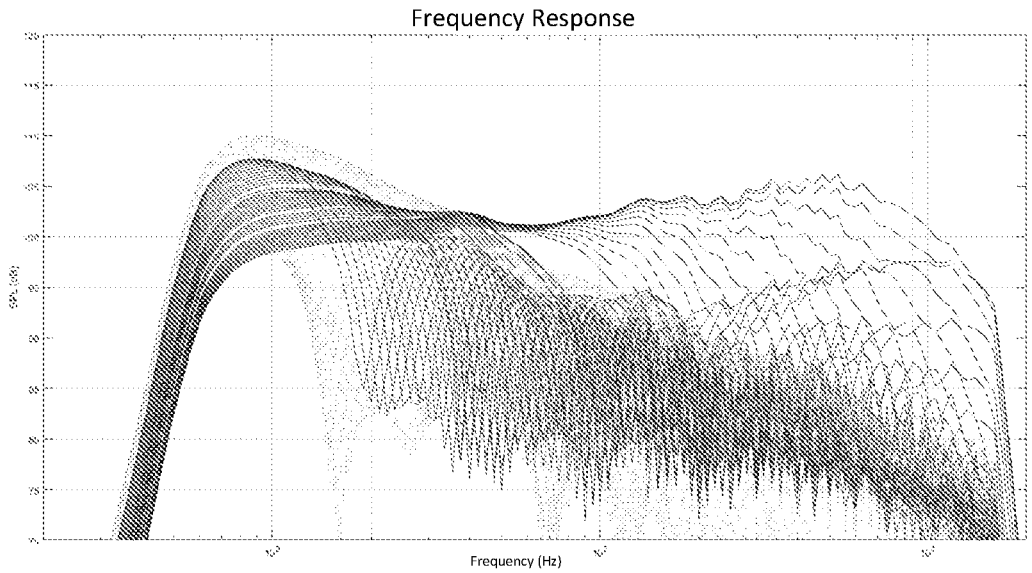
Figure 7C:
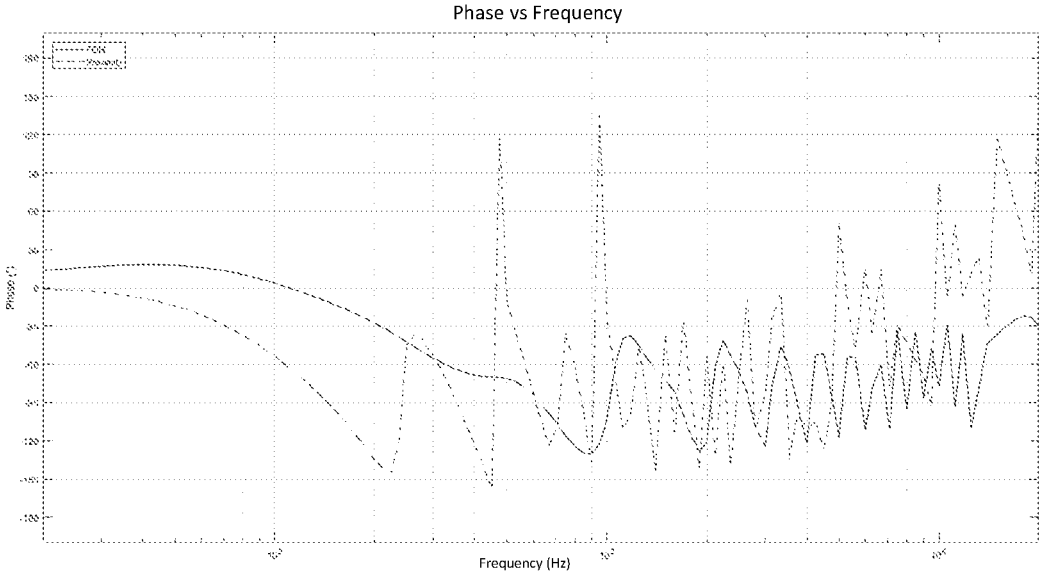
Figure 7D:
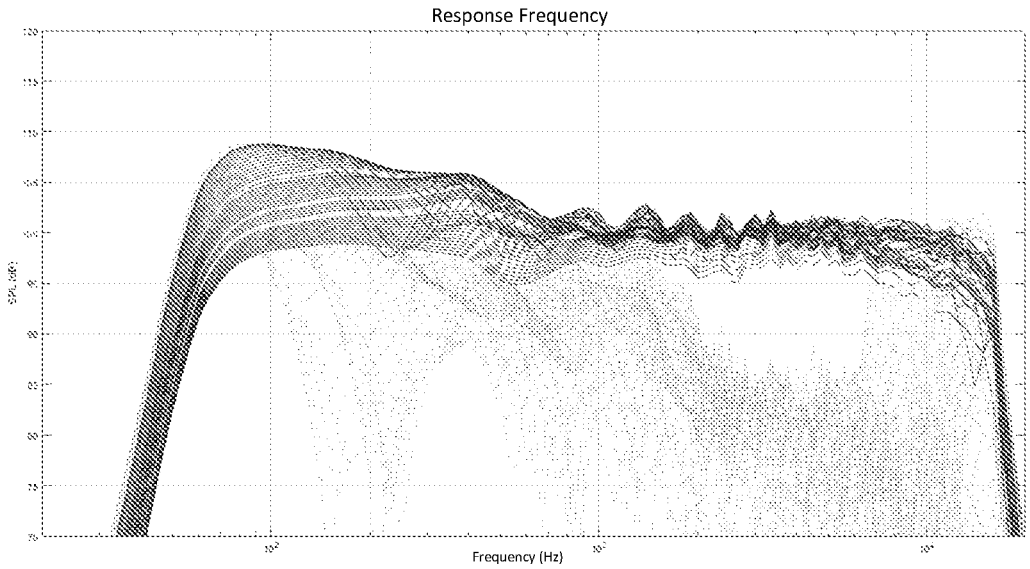
Figure 7E:
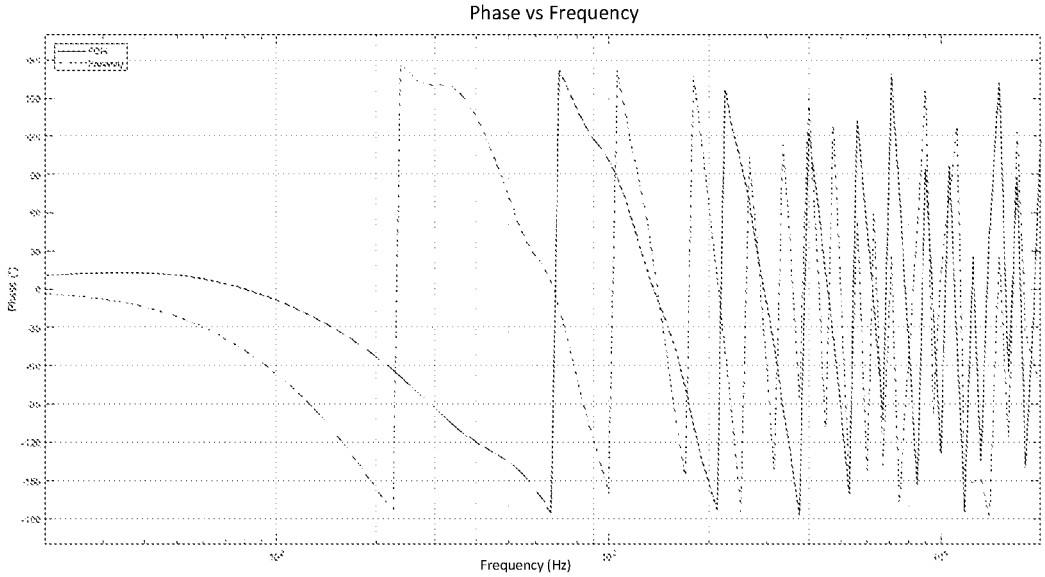

FIGS. 7*a* to 7*e* show the results obtained with a vertical straight stack of speakers comprising a high-frequency acoustic source located between two medium and/or low-frequency acoustic sources in the same horizontal plane. In FIG. 7*a*, the solid lines starting from the straight vertical stack represent the total covered vertical opening. FIG. 7*b* shows the frequency response curves in magnitude generated by such a vertical straight stack before the application of the electronic control on the acoustic sources. The curves in dark grey correspond to the audience, and the curves in light grey points correspond to the stage and to the ceiling. FIG. 7*c* represents the frequency response curves in phase generated by such a vertical straight stack, in the mixing booth (FOH) and at the start of the audience (Proximity), before the application of the electronic control on the acoustic sources, and after the subtraction of the minimum propagation period. FIG. 7*d* shows the frequency response curves in magnitude generated by such a vertical straight stack, after the application of the electronic control on the acoustic sources, and with the same colour codes as FIG. 7*b*. FIG. 7*e* represents the frequency response curves in phase generated by such a vertical straight stack, after the application of the electronic control on the acoustic sources and subtraction of the minimum propagation period, calculated in the mixing booth and at the start of the audience.

Figure 8A:
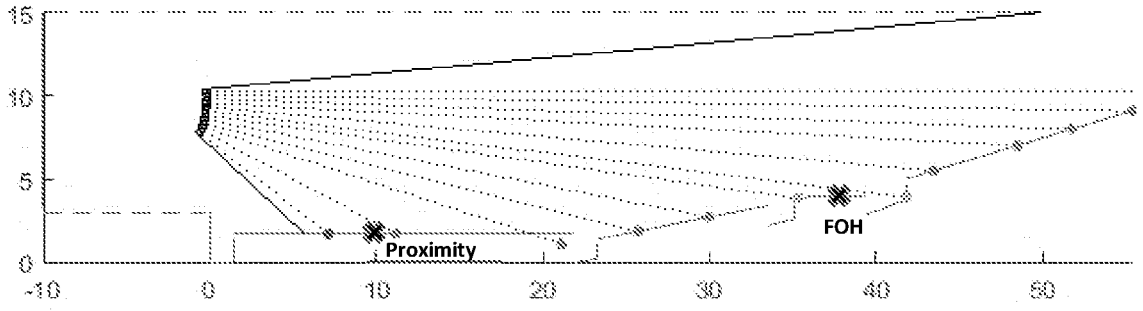
FIGS. 8*a* to 8*e* show the results of a digital simulation performed for a curved vertical stack of speakers; in particular.
Figure 8B:
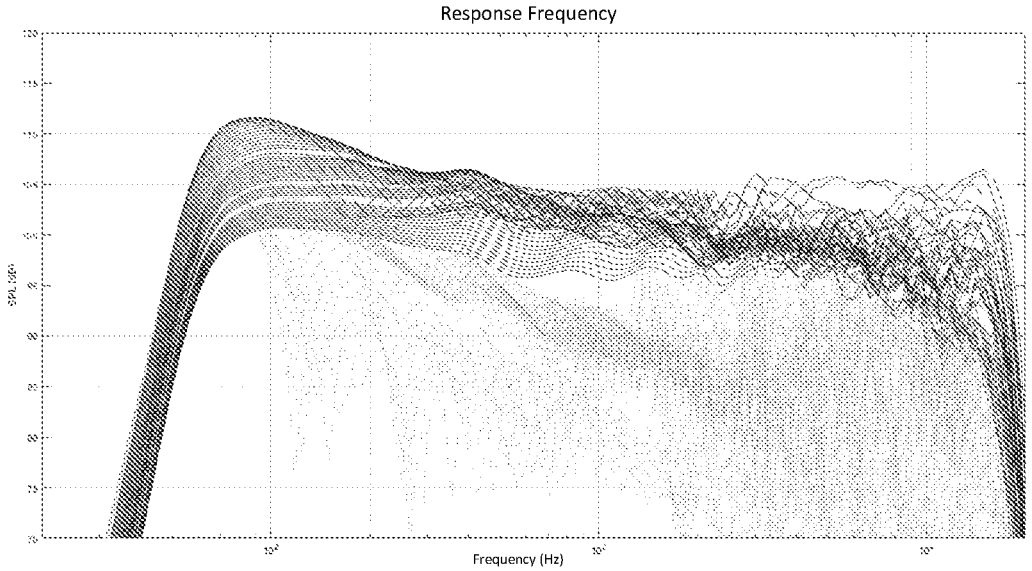
Figure 8C:
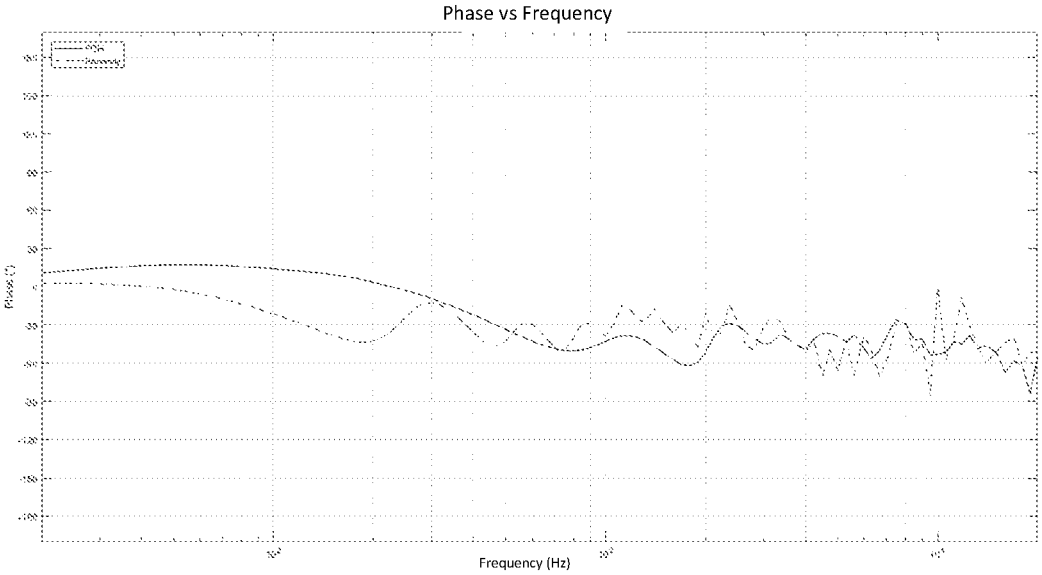
Figure 8D:
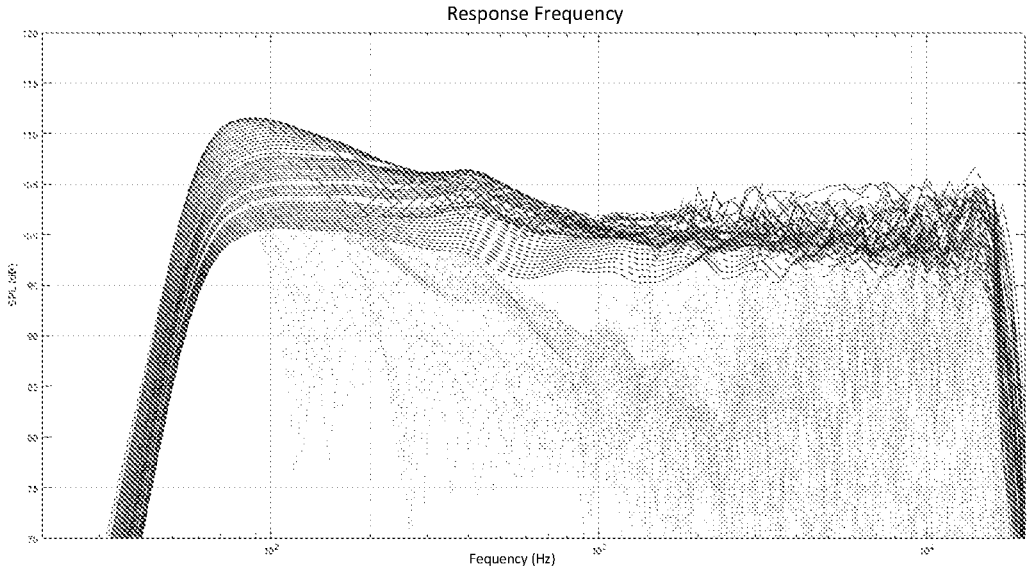
Figure 8E:
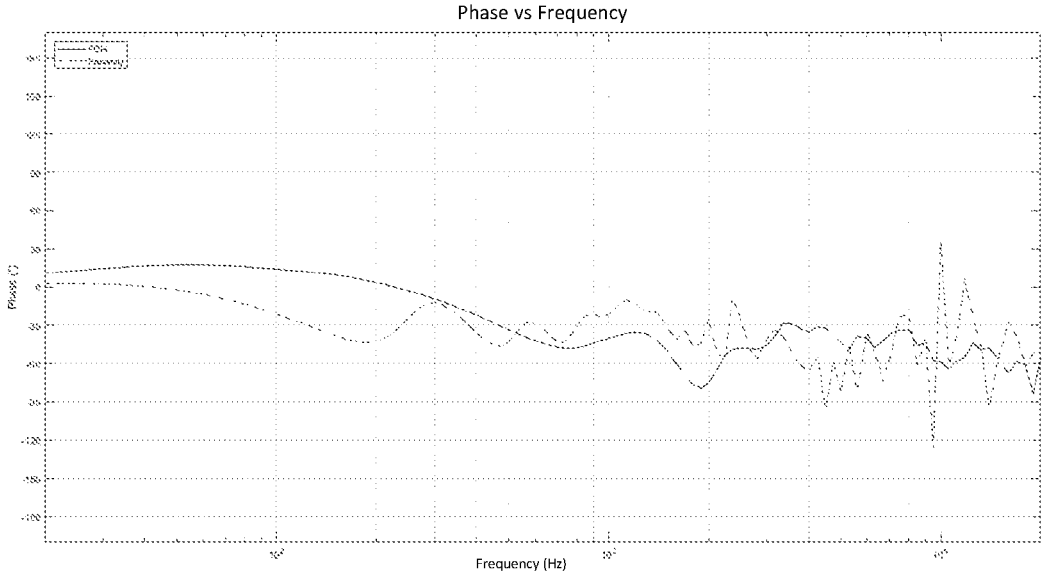

FIGS. 8*e* to 8*e* represent the results obtained with a curved vertical stack of speakers comprising a high-frequency acoustic source located between two medium and/or low-frequency acoustic sources in the same horizontal plane. In FIG. 8*a*, the solid lines starting from the curved vertical stack represent the total covered vertical opening. FIG. 8*b* shows the frequency response curves in magnitude generated by such a curved stack after optimisation of the angles between each source and before the application of the electronic control on the acoustic sources, and with the same colour codes as FIG. 7*b*. FIG. 8*c* shows the frequency response curves in phase generated by such a curved stack after optimisation of the angles between each source, in the mixing booth and at the start of the audience, before the application of the electronic control to the acoustic sources and after subtraction of the minimum propagation period. FIG. 8*d* shows frequency response curves in magnitude generated by such a curved stack, after the optimisation of angles between each source and application of the electronic control to the acoustic sources, and with the same colour codes as FIG. 7*b*. FIG. 8*e* shows the frequency response curves in phase generated by such a curved stack after optimisation of the angles between each source, application of the electronic control on the acoustic sources and subtraction of the minimum propagation period, calculated in the mixing booth and at the start of the audience.

Figure 9A:
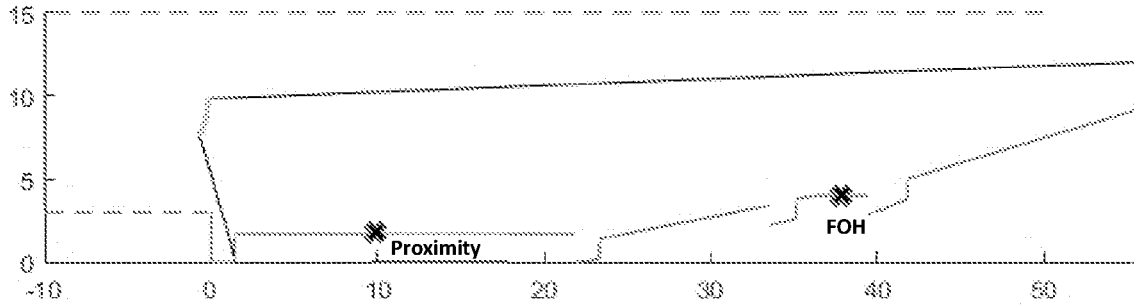
FIGS. 9*a* to 9*e* shows the results of a digital simulation performed for a sound diffusion device according to a second embodiment of the invention; in particular
Figure 9B:
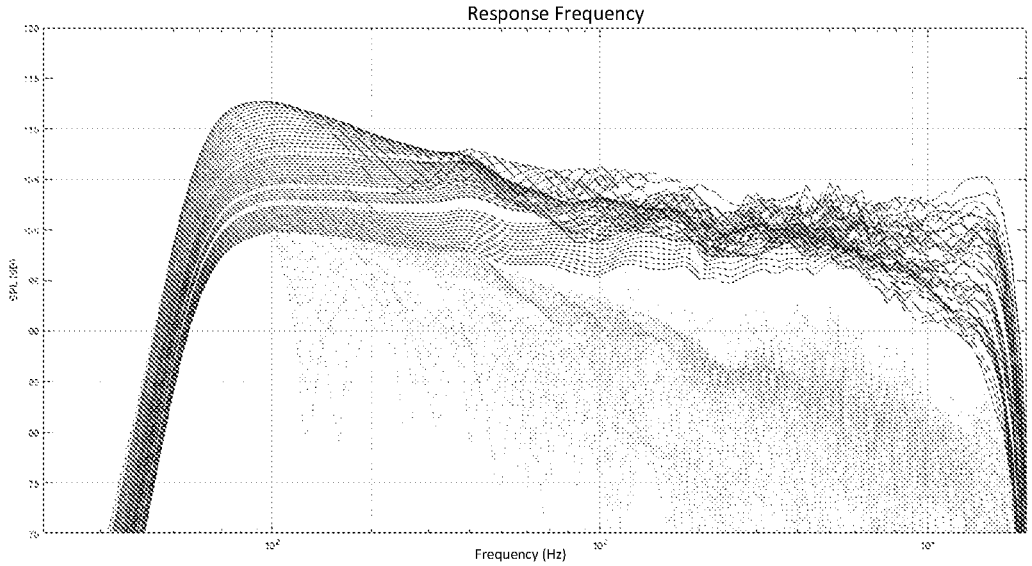
Figure 9C:
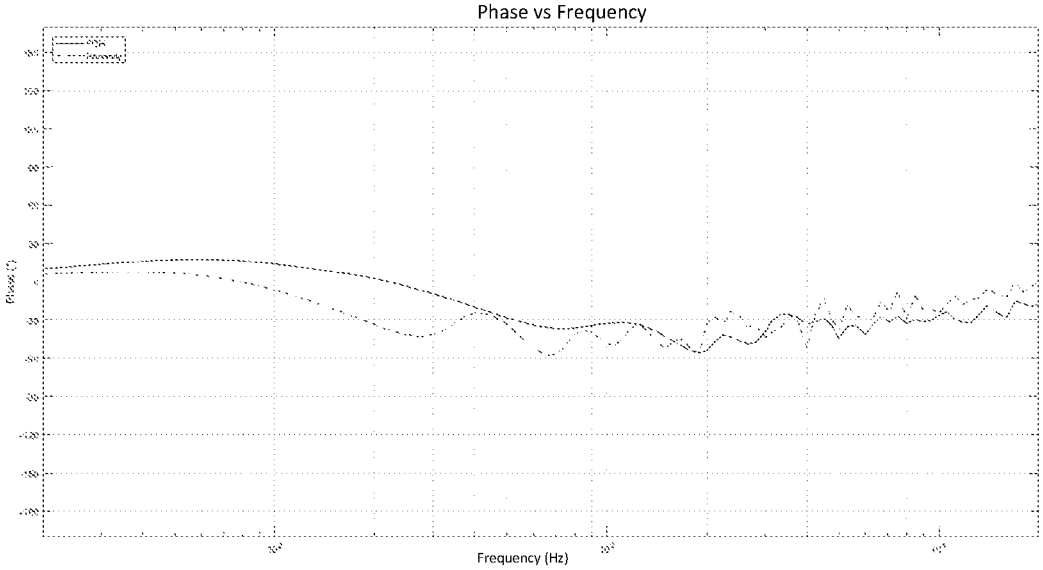
Figure 9D:
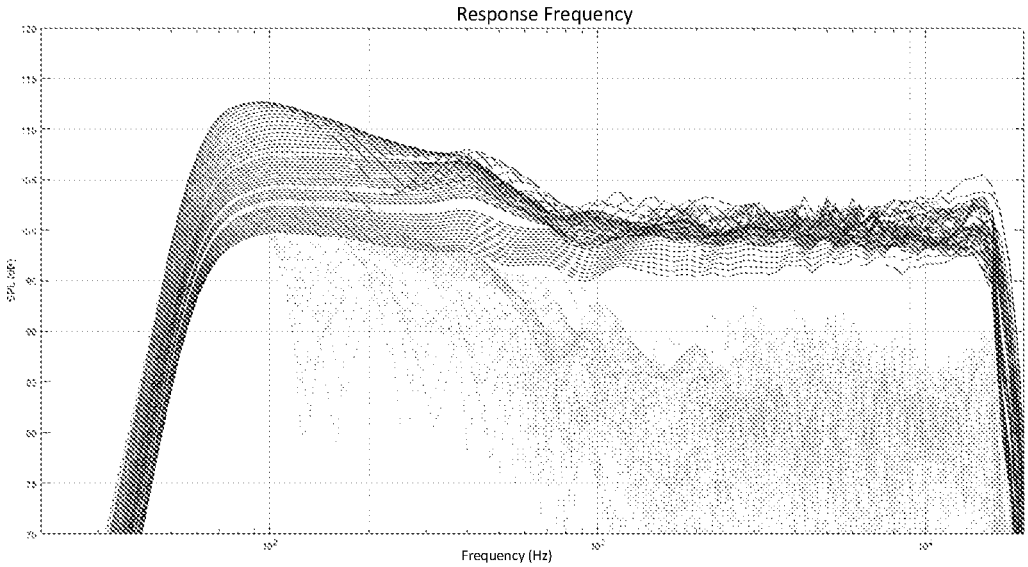
Figure 9E:
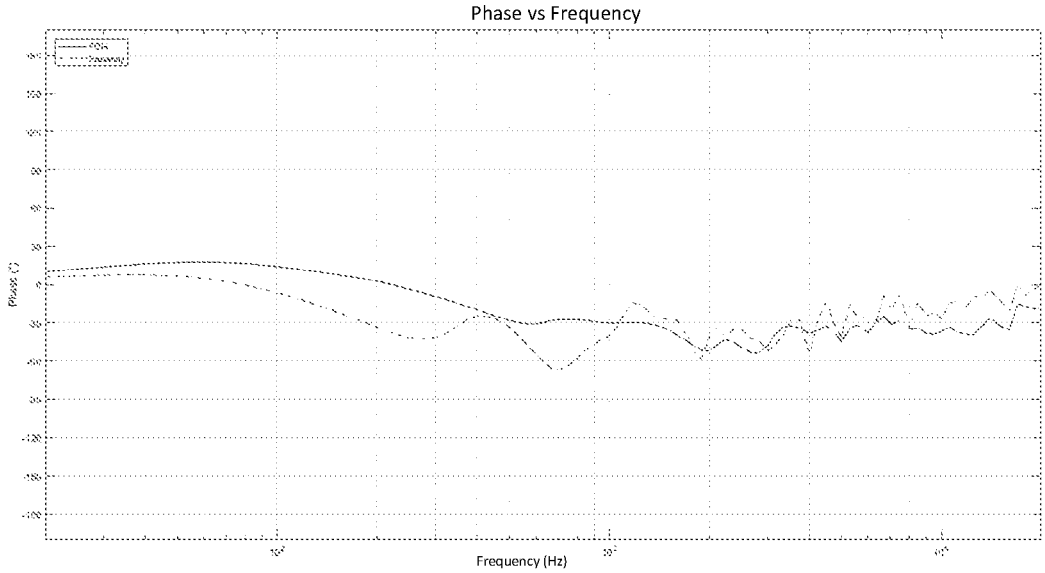

Lastly, FIGS. 9*a* to 9*e* show the results obtained with a sound diffusion device 300 with a fixed non-constant physical curvature as described above. In FIG. 9*a*, the solid lines starting from the sound device 300 show the total covered vertical opening. FIG. 9*b* shows the frequency response curves in magnitude generated by such a device 300 only from the fixed non-constant physical curvature, and with the same colour codes as FIG. 7*b*. FIG. 9*c* shows the frequency response curves in phase generated by such a device 300 only from the fixed non-constant physical curvature, after subtraction of the minimum propagation period, calculated in the mixing booth and at the start of the audience. FIG. 9*d* shows the frequency response curves in magnitude generated by such a device 300, after the application of the electronic control in magnitude and in phase, with an acoustic source via DSP channel, and with the same colour codes as FIG. 7*b*. FIG. 9*e* shows the frequency response curves in phase generated by such a device 300, after the application of the electronic control in magnitude and in phase, with an acoustic source via DSP channel, and after subtraction of the minimum propagation period, calculated in the mixing booth and at the start of the audience.

It is shown that the solution of FIGS. 8*a* to 8*e* provides a satisfactory global response, still perfectible at high frequencies (cluster of curves with less close magnitude, and rougher curve phase). On the other hand, the sound level of the stage and on the ceiling (visible in the light grey curves of FIGS. 8*b* and 8*d*) has a very large number of high frequency peaks, at a level equivalent to that of an audience, which is problematic.

The straight vertical arrangement of FIGS. 7*a* to 7*e*, for which the audience coverage is obtained solely by electronic methods (case of FIGS. 7*d* and 7*e*), in itself leads to an overall satisfactory frequency response in magnitude on the audience. However, the sound level on the stage and especially the ceiling, has peaks from 6 kHz of a level equivalent to that of the audience, associated with the appearance of offset parasite lobes, following the application of parameters of excessive magnitude and phase as in the case of an inclination performed solely in an electronic manner. Furthermore, the phase curves are very rough and translate significant time lags of the arrival to the audience of different frequency components of the sound signal.

However, the results obtained by the configurations of FIGS. 9*a* to 9*e* are satisfactory over the whole audio spectrum, both in magnitude and in phase. The sound level on the stage and the ceiling is much lower than that of the audience, and the phase curves have few fluctuations, before and after the application of electronic correction parameters in magnitude and in phase.

Another way of improving the control of the directivity and the quality of sound emission of the device 300, and compatible with the aforementioned embodiments, is to add orientable flaps.

To achieve this, among the plurality of medium and/or low-frequency acoustic sources there needs to be at least one acoustic source emitting over a medium frequency range. The sound diffusion device 300 can then be equipped with orientable flaps acting on a sound emission of at least one of the high-frequency acoustic sources 320 to produce a sound emission directivity of the high-frequency acoustic source according to a selected angular sector, the high-frequency acoustic source and the acoustic source emitting over a medium-frequency range being configured to emit over a common frequency range.

The sound diffusion device also comprises at least one control module of the digital signal processing type acting on a destination signal of the high-frequency acoustic source and on a destination signal of the acoustic source emitting over a medium-frequency range so as to apply in the common frequency range at least one parameter of magnitude on the high-frequency acoustic source and/or on the acoustic source emitting over a medium-frequency range as well as at least on phase parameter on the high-frequency acoustic source and/or the acoustic source emitting over a medium-frequency range so as to produce a directivity of sound emission of the couple formed by the high-frequency acoustic source and the acoustic source emitting over a medium-frequency range according to the same angular sector selected that the directivity produced by the orientable flaps.

The different variants of this embodiment are described in document EP 3 063 950 B1.

Depending on the physical distribution of the audience 2, it may be advantageous to have two specific types of sound diffusion device 300 as described above.

Figure 10:
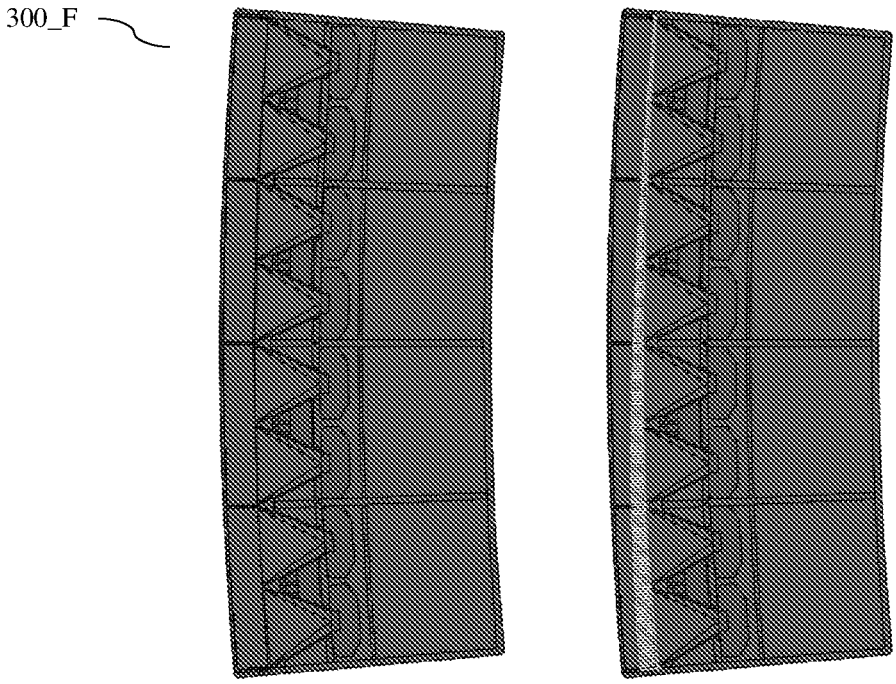
FIG. 10 shows a sound diffusion device "with an extended range"

If the sound diffusion device emits towards an audience remote from the stage or in grazing incidence, a sound diffusion device "with an extended range" 300_F is defined, wherein the assembly of acoustic high-frequency sources 310 produces a global sound emission directivity with a total vertical angle of opening less than or equal to 20°, as illustrated in FIG. 10. This corresponds to a relatively weak fixed non-constant curvature, represented by lines perpendicular to the low wavelength on the right device.

The graph on the right of FIG. 10 illustrates another representation of the progression of the physical curvature of the curved vertical stack of high-frequency acoustic sources 310 formed by the sound diffusion device "with an extended range" 300_F, relative to the subfigure of FIG. 10, where the values of curvature of the sound diffusion device "with an extended range" 300_F are represented by lines perpendicular to the wave front. This graph shows the progression of the value of the angle alpha_i between the i-st and i+1st acoustic source, i being an integer from 1 a N−1, N being the number of high-frequency acoustic sources 310. It can be seen that the distance between the angle between the two highest high-frequency acoustic sources 310 and that between the two lowest high-frequency acoustic sources 310 (in vertical direction) is small, which corresponds to a relatively low fixed non-constant curvature. In this particular case, the physical curvature of the curved vertical stack is monotonic.

Figure 11:
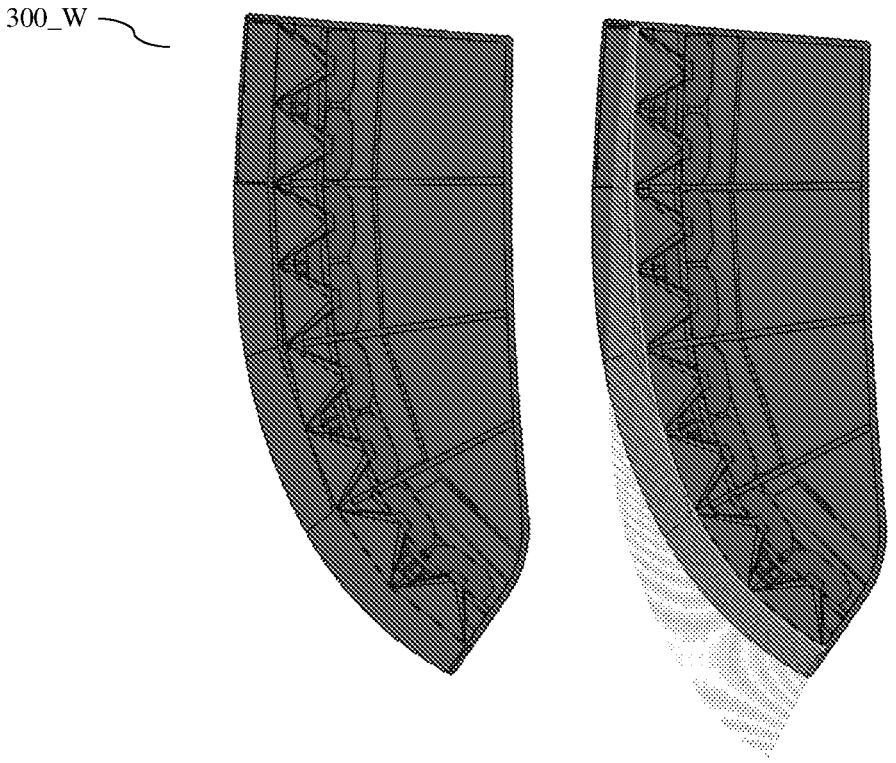
FIG. 11 shows a sound diffusion device "with an extended vertical opening"

For instances where the sound diffusion device emits to an audience close to the stage or the latter is distributed over a significant vertical angular sector, a sound diffusion device "with an extended vertical opening" 300_W is defined, wherein the assembly of high-frequency acoustic sources 310 produces a global sound emission directivity having a total vertical opening angle greater than 20°, as illustrated in FIG. 11. This corresponds to a greater fixed non-constant curvature represented by lines perpendicular to the wave front of great length on the right device.

The graph on the right of FIG. 11 illustrates another representation of the progression of the physical curvature of the curved vertical stack of high-frequency acoustic sources 310 formed by the sound diffusion device "with an extended vertical opening" 300_W, relative to the subfigure of FIG. 11, where values of curvature of the sound diffusion device "with an extended vertical opening" 300_W are represented by lines perpendicular to the wave front. This graph shows the progression of the physical curvature of the curved vertical stack of acoustic high-frequency sources 310 formed by the sound diffusion device "with an extended vertical opening" 300_W, namely the progression of the value of the angle alpha_i between the i-st and i+1-st acoustic source, i being an integer from 1 to N−1, N being the number of high-frequency acoustic sources 310. It can be seen that the distance between the angle between the two highest high-frequency acoustic sources 310 and that between the two lowest high-frequency acoustic sources 310 (in vertical direction), is greater than in FIG. 10, which corresponds to a greater fixed non-constant curvature than in the case of FIG. 10 and a sound diffusion device "with an extended range" 300_F. In this particular case also the physical curvature of the curved vertical stack is monotonic.

Figure 12:
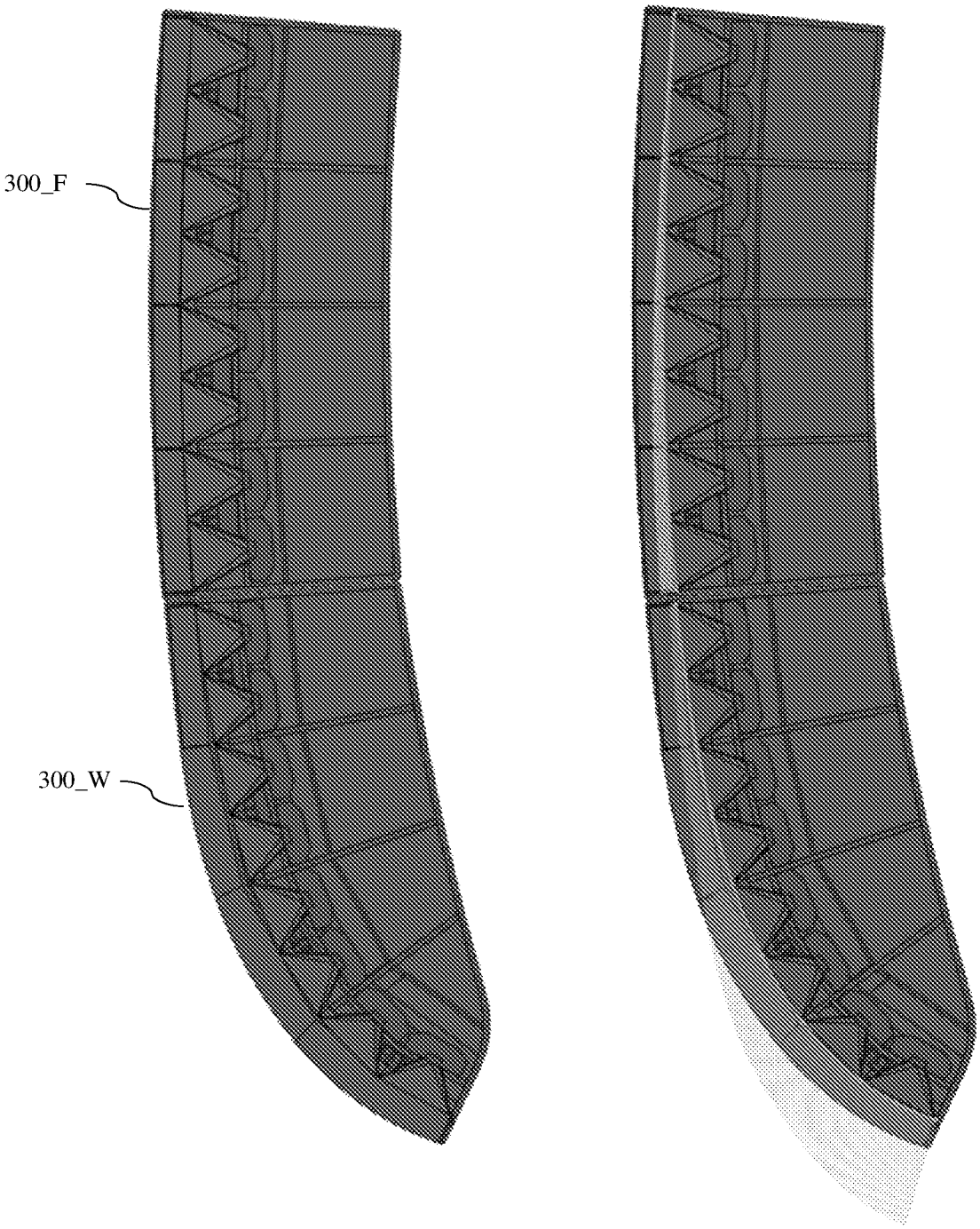
FIG. 12 shows a sound diffusion assembly according to a first embodiment.

For configurations of the physical distribution of the audience 2 requiring a greater sound power or for more complex distributions and/or more widespread distributions, a sound diffusion assembly comprises at least a first sound diffusion device "with an extended range" 300_F and a sound diffusion device 300, 300_F or 300_W as defined above and superimposed such that the resulting sound diffusion assembly generates a vertical wave front with a fixed non-constant curvature as illustrated in FIG. 12.

In other words, the sound diffusion device "with an extended range" 300_F can be coupled to another sound diffusion device 300, 300_F or 300_W as defined above and can be assembled by fixing means.

In particular, the sound diffusion device "with an extended range" 300_F can be coupled to an identical sound diffusion device "with an extended range" 300_F.

A sound diffusion assembly, resulting from the superposition of two sound diffusion devices as described above, forms a curved vertical stack having a fixed non-constant physical curvature.

Figure 13:
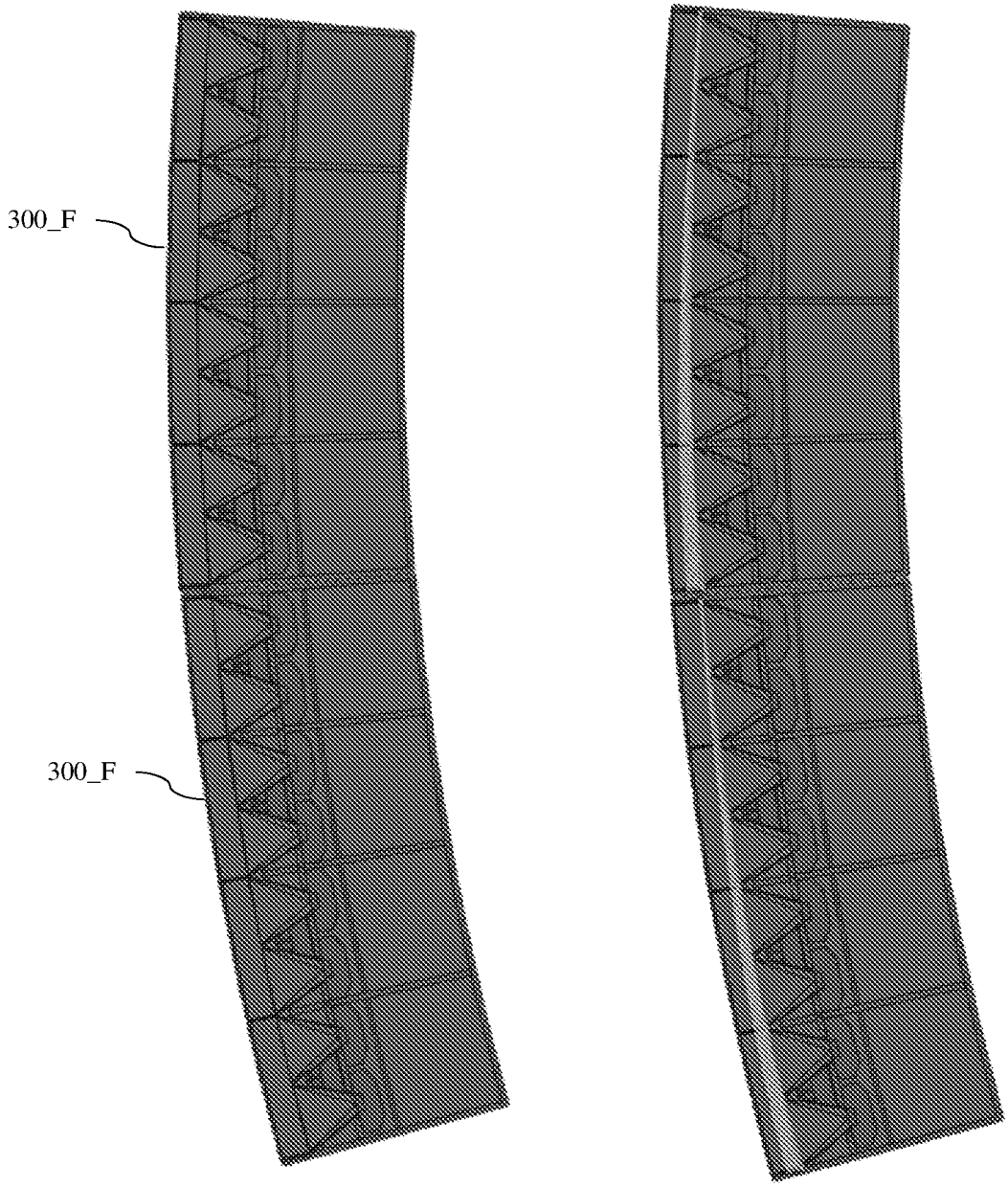
FIG. 13 shows a sound diffusion assembly according to a second embodiment.

To compensate for a possible non-monotonicity generated by the assembly of devices as in the case of FIGS. 12 and 13, the high-frequency sources can be controlled individually electronically in amplitude and in phase.

This can be in particular the non-monotonicity of the physical curvature of the curved vertical stack formed by the sound diffusion assembly. The electronic control in amplitude and in phase of high-frequency acoustic sources 320 and/or low and/or medium-frequency acoustic sources 330 can thus make it possible to adjust a sound wave front emitted by the sound diffusion assembly to the diffusion objectives for an audience.

Indeed, the superposition of two devices "with an extended range" 300_F can generate a discontinuity in the curvature and therefore a non-monotonicity that can be seen by the hatching in FIG. 13.

As shown in FIGS. 10 and 11, the graph on the right of FIG. 13 illustrates another representation of the progression of the physical curvature of the curved vertical stack of high-frequency acoustic sources 310 formed by a sound diffusion assembly resulting from the assembly of two sound diffusion devices "with an extended range" 300_F, relative to the subfigure of FIG. 13 where the curvature values of this sound diffusion assembly are represented by lines perpendicular to the wave front. In this graph, a non-monotonicity of the progression of angles is observed between the sources 7 and 9, corresponding to a break in the monotonicity of the progression of the physical curvature of the curved vertical stack formed by the sound diffusion assembly. In this case, a DSP control makes it possible to readjust the sound wave front emitted by the sound diffusion assembly to adapt it to the diffusion objectives.

Lastly, to facilitate the installation, the diffusion assembly can advantageously comprise fixing means configured such that each sound diffusion device is connected to the sound diffusion device located above, respectively below, by fixing points without angular adjustment.

LIST OF REFERENCE SIGNS

1 stage
2 audience

3 sound diffusion device
10 standard stereo arrangement
100 arrangement suitable for diffusing a spatialised sound signal
300 sound diffusion device
300_F sound diffusion device "with an extended range"
300_W sound diffusion device "with an extended vertical opening"
310 box
320 high-frequency acoustic source
330 low or medium-frequency acoustic source
340 wave guide
R Right
FOH Mixing Booth (Front of House)
L Left
W Width of the stage

The invention claimed is:

1. Sound diffusion device comprising a single box and, in this single box, at least two superimposed high-frequency acoustic sources, and a plurality of superimposed medium-frequency and/or low-frequency acoustic sources and arranged to the left and/or to the right of the high-frequency acoustic sources, the high-frequency acoustic sources being coupled individually to a wave guide and arranged according to a curved vertical stack having a fixed non-constant physical curvature;

wherein the high-frequency sources are controlled individually electronically in amplitude and phase in such a way as to adjust the resulting wave front to diffusion objectives for an audience.

2. Sound diffusion device according to claim 1, wherein each wave guide comprises an output, the outputs of the wave guides being arranged in a perfectly joined manner, so as to form a continuous band.

3. Sound diffusion device according to claim 1, wherein the progression of the physical curvature of the curved vertical stack is monotonic.

4. Sound diffusion device according to claim 1, such that among the plurality of medium and/or low-frequency acoustic sources, there is at least one acoustic source emitting in a medium-frequency range, the sound diffusion device also comprising:

orientable flaps acting on a sound emission of at least one of the high-frequency acoustic sources to produce a sound emission directivity of the high-frequency acoustic source according to a selected angular sector, the high-frequency acoustic source and the acoustic source emitting over a medium-frequency range being configured to emit over a common range of frequencies; and at least one control module of the digital signal processor type acting on a destination signal of the high-frequency acoustic source and on a destination signal of the acoustic source emitting over a medium-frequency range so as to apply in the common range of frequencies at least one parameter of magnitude to the high-frequency acoustic source and/or the acoustic source emitting in a medium-frequency range as well as at least one phase parameter on the high-frequency acoustic source and/or on the acoustic source emitting in a medium-frequency range to produce a sound emission directivity of the couple formed by the high-frequency acoustic source and the acoustic source emitting in a medium-frequency range according to the same angular sector selected as the directivity produced by the orientable flaps.

5. Sound diffusion device with an extended range according to claim 1, wherein the assembly of high-frequency acoustic sources produces a global sound emission directivity with a total vertical opening angle less than or equal to 20°.

6. Sound diffusion device with an extended range according to claim 5, characterised in that it can be coupled and superimposed from above or below with a second sound diffusion device.

7. Sound diffusion device with an extended range according to claim 6, wherein the second sound diffusion device is identical to the sound diffusion device with an extended range.

8. Sound diffusion assembly comprising at least one first sound diffusion device with an extended range according to claim 6 and the sound diffusion device, superimposed, and forming a curved vertical stack and having a fixed non-constant physical curvature.

9. Sound diffusion assembly according to claim 8, wherein the high-frequency sources are individually controlled electronically in amplitude and in phase so as to adjust the resulting wave front to diffusion objectives for an audience and to compensate for possible non-monotonicity generated by an assembly of devices with one another.

10. Sound diffusion assembly according to claim 9, wherein the non-monotonicity is that of the physical curvature of the curved vertical stack formed by the sound diffusion assembly.

11. Sound diffusion device with an extended vertical opening according to claim 1, wherein the assembly of high-frequency acoustic sources produces a global sound emission directivity with a total vertical opening angle greater than 20°.

12. Sound diffusion device according to claim 1, wherein the electronic control and amplification channels are suitable for supplying each or a plurality of high-frequency sources, as well as each or a plurality of acoustic sources among the plurality of medium-frequency and/or low-frequency acoustic sources.

13. Sound diffusion device according to claim 1, wherein a physical curvature of the curved vertical stack is the same as a curvature of an arc representing a profile curve of the curved vertical stack.

* * * * *